United States Patent [19]

McGaughan

[11] Patent Number: 4,881,323

[45] Date of Patent: Nov. 21, 1989

[54] DISPOSABLE AEROSOL RAZOR

[76] Inventor: Thomas McGaughan, 1601 Lee St., Melrose Park, Ill. 60160

[21] Appl. No.: 146,624

[22] Filed: Mar. 29, 1988

[51] Int. Cl.[4] ..... B26B 21/44

[52] U.S. Cl. ..... 30/41; 30/86

[58] Field of Search ..... 30/41, 86, 90

[56] References Cited

U.S. PATENT DOCUMENTS

| | | | |
|---|---|---|---|
| 4,377,034 | 3/1983 | Druash et al. | 30/41 |
| 4,433,483 | 2/1984 | Lazarus | 30/41 |
| 4,625,402 | 12/1986 | Karouossl | 30/41 |
| 4,791,723 | 12/1988 | Jacobson | 30/41 |

*Primary Examiner*—Frank T. Yost
*Assistant Examiner*—Michael D. Folkerts
*Attorney, Agent, or Firm*—Emrich & Dithmar

[57] ABSTRACT

A disposable razor is attached to a first end of a compact aerosol shaving cream container/dispenser which includes an aperture in a second end thereof. A linear, elongated tube extends from the aperture in the second end of the container/dispenser to an inner portion thereof and is movable along its length between first and second positions. With the tube spring-biased to the first non-use position wherein shaving cream is prevented from entering the tube and exiting the container/dispenser, the tube may be manually moved to the second position by a user by means of a lever, or handle, mounted to the tube to allow the pressurized shaving cream to enter the tube and exit via the aperture in the container/dispenser. Release of the handle allows the coil spring to move the tube to the non-use position wherein the pressurized shaving cream is prevented from entering the tube and exiting the container/dispenser.

3 Claims, 1 Drawing Sheet

DISPOSABLE AEROSOL RAZOR

BACKGROUND OF THE INVENTION

The razor is of aerosol type the first of its kind. Large enough to be able to give a number of good shaves and then can be disposed of when the aerosol has been discharged.

OBJECTS AND SUMMARY OF THE INVENTION

It is an object of the present invention to provide an inexpensive, easily operated, reliable and compact disposable safety razor.

It is another object of the present invention to provide an integral safety razor with handle and shaving cream container/dispenser.

This invention contemplates a disposable aerosol razor comprising: a container/dispenser containing a shaving cream under pressure and having an aperture on a first end thereof and an elongated cylindrical bore aligned with the aperture therein, wherein the cylindrical bore includes a first end extending into the shaving cream; a safety razor affixed to a second end of the container/dispenser; an elongated linear tube disposed in the bore and movable along the length thereof and having a first open end positioned adjacent to the aperture in the container/dispenser and an aperture adjacent to a second end thereof; biasing means coupled to the tube for urging the tube to a first position in the bore, wherein the aperture adjacent to the second end of the tube is disposed within the bore and its second end blocks the first end of the bore to prevent shaving cream from entering the bore; and manual engaging means coupled to the tube for displacing the tube to a second position in the bore, wherein the aperture adjacent to the second end of the tube extends into the shaving cream allowing the shaving cream to enter the tube and exit the container/dispenser via the aperture therein.

The body is of two piece construction one end has the razor and the other end has the spout for the aerosol. The aerosol end is protected by a cap. The cap is removed when the aerosol is discharging the correct amount of foam. The cap should be replaced before shaving begins. The razor end is protected by a safety cap.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DESCRIPTION OF THE PREFERRED EMBODIMENT

Figure 1:
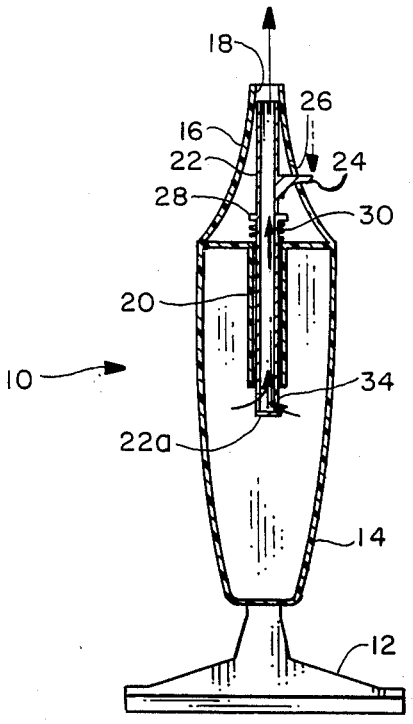
FIG. 1 is a sectional view of an aerosol disposable razor in accordance with the present invention.

Referring to FIG. 1, there is shown a sectional view of an aerosol disposable razor 10 in accordance with the present invention. The aerosol disposable razor 10 includes a safety razor 12 mounted to one end of an aerosol shaving cream container/dispenser 14. Disposed within the container/dispsenser 14 is a shaving cream in fluid form under pressure, which is not shown in the figure for simplicity. Disposed on a second, opposed end of the container/dispenser 14 is a spout, or shaving cream discharge arrangement, 16 having an aperature 18 therein. Disposed within the container/dispenser 14 and aligned with the aperture 18 therein is an elongated, linear tube 22. A first end of the tube 22 is disposed in close proximity to the aperture 18 within the spout 16. Also disposed within the container/dispenser 14 is a cylindrical bore 20 within which the tube 22 is positioned. Tube 22 is freely displaceable within and along the length of the cylindrical bore 20. A handle, or lever, 24 coupled to an outer wall of the tube 22 permits the tube to be manually displaced by one using the aerosol disposable razor 10. The handle 24 extends through a slot 26 in the spout 16.

Figure 2:
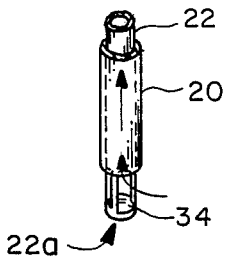
FIG. 2 is a perspective view illustrating in greater a portion of the aerosol disposable razor of FIG. 1.

A shoulder 28 is disposed about the outer periphery of the tube 22. A coiled spring 30 is positioned between the tube shoulder 28 and one end of the cylindrical bore 20 which is positioned within and coupled to an inner portion of the container/dispenser 14. The coiled spring 30 urges the tube 22 upward as shown in FIG. 1. The biasing force of the coiled spring 30 can be overcome by downward displacement of the handle 24 and the tube 22 to which it is coupled as shown by the direction of the arrow adjacent to the handle. The tube 22 is provided with a plurality of apertures 34 adjacent to its lower end as shown in detail in FIG. 2. When the tube 22 is displaced downward as previously described, the apertures 34 adjacent to the end of the tube extend out beyond the lower end of the cylindrical bore 20 permitting pressurized shaving cream within the container/dispenser 14 to flow up the tube, as shown by the direction of the arrows in the figures, and out of the aperture 18 in the spout 16. When the downward force is removed from the handle 24, the upward urging of the coiled spring 30 displaces the tube 22 upward so that the apertures 34 adjacent the lower end thereof are retracted into the cylindrical bore 20. In this position, shaving cream is prevented from entering the tube 22 and exiting the container/dispenser 14.

Figure 3:
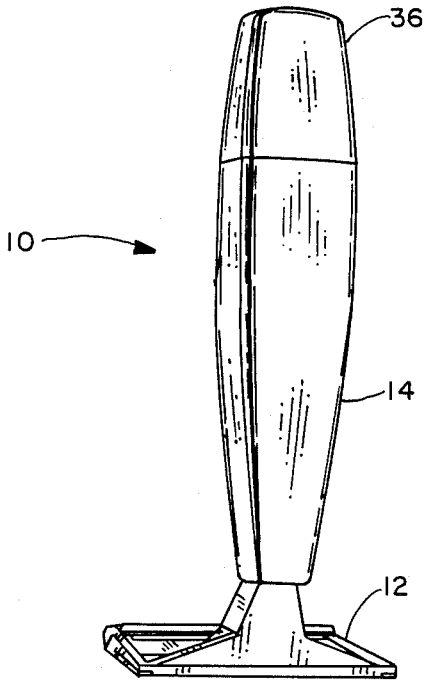
FIG. 3 is a perspective view of an aerosol disposable razor of the present invention having a cap thereon.
Figure 4:
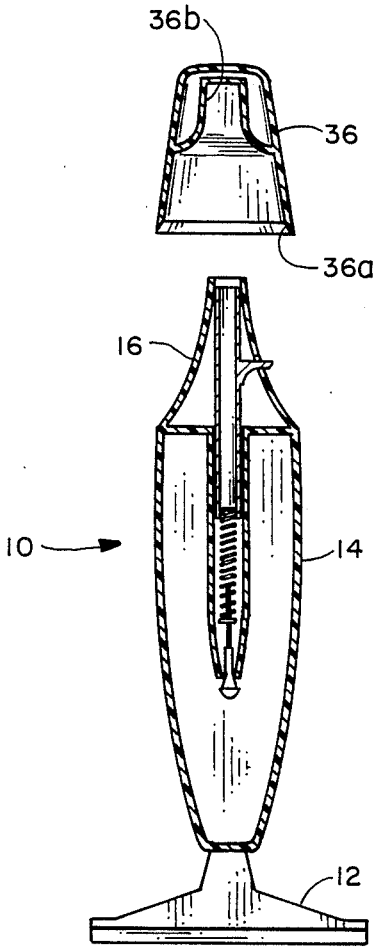
FIG. 4 is a sectional view of the aerosol disposable razor of FIG. 3 illustrating additional details of the cap.

Referring to FIGS. 3 and 4, there are shown the manner in which a cap 36 may be positioned on one end of the container/dispenser 14 of the aerosol disposable razor 10. The cap 36 includes a recessed inner portion **36*b* as shown in FIG. 4 to accommodate the distal end of the spout 16. The cap further includes an inner engaging lip 36 adapted to receive and tightly engage a portion of the outer periphery of the container/dispenser 14** for maintaining the cap tightly thereon.

While various changes may be made in the detail construction, it is understood that such changes will be within the spirit and scope of the present invention, as is defined by the appended claims.

What is claimed is:

1. A disposable aerosol razor comprising:

a container/dispenser containing a shaving cream under pressure and having an aperture on a first end thereof and an elongated cylindrical bore aligned with said aperture therein, wherein said cylindrical bore includes a first end extending into the shaving cream;

a safety razor affixed to a second end of said container/dispenser;

an elongated linear tube disposed in said bore and movable along the length thereof and having a first open end positioned adjacent to the aperture in said container/dispenser and an aperature adjacent to a second end thereof;

biasing means coupled to sid tube for urging said tube to a first position in said bore, wherein the aperture adjacent to the second end of said tube is disposed within said bore and its second end blocks the first end of the bore to prevent shaving cream from entering said bore; and manual engaging means coupled to said tube for displacing said tube to a second position in said bore, wherein the aperture adjacent to the second end of said tube extends into the shaving cream allowing the shaving cream to enter said tube and exit said container/dispenser via the aperture therein.

2. The disposable aerosol razor of claim 1 further comprising a removable cap positioned on the first end of said container/dispenser so as to cover the aperture therein.

3. The disposable aerosol razor of claim 1 wherein said biasing means includes a coiled spring.

* * * * *